US005752350A

United States Patent [19]

Maiuccoro

[11] Patent Number: 5,752,350

[45] Date of Patent: May 19, 1998

[54] MODULAR STAIR SUPPORT SYSTEM USEABLE FOR A POOL OR SPA

[75] Inventor: John V. Maiuccoro, Latham, N.Y.

[73] Assignee: Imperial Pools, Inc., Latham, N.Y.

[21] Appl. No.: 810,686

[22] Filed: Feb. 28, 1997

Related U.S. Application Data

[60] Provisional application No. 60/027,446 Sep. 27, 1996.

[51] Int. Cl. [6] ..... E04F 11/00

[52] U.S. Cl. ..... 52/169.7; 52/8; 52/182; 52/184; 52/191

[58] Field of Search ..... 52/6, 8, 182, 191, 52/184, 169.7; 4/494, 496

[56] References Cited

U.S. PATENT DOCUMENTS

| | | | |
|---|---|---|---|
| 3,744,198 | 7/1973 | Boassy . | |
| 3,752,531 | 8/1973 | Jones | 52/8 X |
| 3,755,981 | 9/1973 | West | 52/184 |
| 3,848,378 | 11/1974 | Witte | 52/184 |
| 3,952,338 | 4/1976 | Troxclair | 52/184 X |
| 4,011,695 | 3/1977 | Simmons, Sr. | 52/9 X |
| 4,125,175 | 11/1978 | Ernst . | |
| 4,343,120 | 8/1982 | Witte | 52/184 |
| 4,565,036 | 1/1986 | Lyman, Jr. | 52/9 |
| 4,589,237 | 5/1986 | Dahowski | 52/184 |
| 4,599,835 | 7/1986 | Rinke | 52/184 |
| 4,633,625 | 1/1987 | Dieban et al. | 52/6 X |
| 4,854,092 | 8/1989 | Chatenay épouse | 52/6 X |
| 4,873,802 | 10/1989 | Dahowski . | |
| 4,881,351 | 11/1989 | Hamm . | |
| 5,086,595 | 2/1992 | Maiuccoro et al. . | |
| 5,107,640 | 4/1992 | Gefroh et al. . | |
| 5,228,148 | 7/1993 | Weir . | |
| 5,307,527 | 5/1994 | Schober . | |
| 5,369,921 | 12/1994 | Glenn . | |
| 5,400,556 | 3/1995 | Favaron . | |
| 5,644,873 | 7/1997 | Bourgault | 52/184 X |

*Primary Examiner*—Wynn Wood Coggins
*Attorney, Agent, or Firm*—Heslin & Rothenberg, P.C.

[57] ABSTRACT

A modular support system useable for a pool or spa is disclosed. A prefabricated pool or spa stairs may be supported by utilizing a plurality of stiffeners each extending along the length of the bottom of a step of the prefabricated stairs. Within the stiffeners are a plurality of openings within which posts may be inserted. The posts contact the bottom surface of the top side of each stiffener to support the stiffener and a load placed upon the step supported by the stiffener. The stiffener is constructed to help minimize deflection of the step when a load off is placed thereon. A locking mechanism may be used to lock each post within into the opening. If desired, only posts supporting the top step may be placed upon a stable surface and the remaining posts, after insertion into their respective openings, may remain hanging above the stable surface. Concrete may be poured on the stable surface to embed each of the posts therein.

40 Claims, 5 Drawing Sheets

MODULAR STAIR SUPPORT SYSTEM USEABLE FOR A POOL OR SPA

FIELD OF THE INVENTION

This invention relates to a modular stair support system, in particular to a modular stair support system useable for pre-fabricated plastic swimming pool or spa stairs.

PRIORITY CLAIM

This application claims the priority of U.S. Provisional patent application No. 60/027,446 filed Sep. 27, 1996, the specification of which is incorporated by reference and made a part of this disclosure herein.

BACKGROUND OF THE INVENTION

The installation of support systems for prefabricated pool stairs is typically time consuming and tedious. One commonly used method involves the construction under the stairs of a supplementary support system using columns or piers formed with stacks of concrete blocks and/or bricks which rest on a suitable concrete footing. The columns or piers are built up to and abut the underside of one or more steps of the stairs. This particular system requires construction of a footing, typically concrete, that is level and resists subsequent settling and/or misalignment. Often, to ensure proper levelling, shims may be required to level the prefabricated stair unit which should be properly aligned with the swimming pool walls, panels and coping.

U.S. Pat. No. 4,589,237 discloses a system for supporting a pre-fabricated pool stairs. However, this system does not provide for sufficient elimination of flexing of the steps of the stairs when stepped on by a person.

In U.S. Pat. No. 4,873,802, a system for supporting pre-fabricated pool stairs provides for the use of stiffeners bonded to the underside of the steps of the pool stairs to help avoid flexing of the steps. The stiffeners and, therefore, the steps of the stairs are supported by posts. However, to eliminate or substantially reduce flexing of each step, posts are embedded in a footing and are used to support each step.

The disclosure of U.S. Pat. Nos. 4,589,237 and 4,873,802 are each incorporated herein by reference and made a part of the disclosure herein.

The aforementioned pool stair support systems suffer from certain drawbacks. For instance, according to the teachings of the aforementioned references, there will be a tendency for the stiffeners to delaminate or separate from the underside of the steps of the stairs because of contraction and expansion of the parts, and settling. These systems also require that, if the posts are manufactured of a specific height and predrilled with holes for fastening, that the footings rest at a specific height for proper placement of the post. Alternatively, if the posts are not pre-fabricated to a specific length or predrilled, then cutting of the post and time-consuming drilling of holes therethrough are required in the field.

It is therefore desirable to utilize a stair support system useable for swimming pools or spas which provides for the number of posts embedded in the concrete footing be minimized. In this regard, it is desirable to utilize embedded posts to support only the top step of the pre-fabricated stairs.

It is also desirable that the stair support system be modular so that it can be used to support various different sized pre-fabricated stairs for pools and which resists delamination with the underside of the pool stairs.

Finally, it is desirable to utilize a support system which may be used on any pre-fabricated stair, which may be installed by bonding or attaching parts thereof to the stairs during field installation, and/or whereby structural members of the system may be cut to size during field installation.

SUMMARY OF THE INVENTION

The aforementioned goals and objectives may be achieved with the modular stair support system constructed and utilized in accordance with the principles of the present invention.

A modular stair support system useable for a pool or spa in accordance with the present invention includes a plurality of posts for supporting steps of a prefabricated set of stairs, a plurality of stiffeners extending lengthwise substantially along the entire length of the bottom surface of the steps. The stiffeners have a plurality of openings therein being sized to receive the posts therein while maintaining axial alignment of the posts in a direction substantially normal to steps.

The stiffeners may be bonded via a top side, to the bottom of said steps and may have a width greater than the diameter of the posts. The stiffeners may also have a pair of side walls extending from the top side which may be separated by a distance greater than or equal to the outside diameter of the posts. A bottom wall extends between the side walls of the stiffeners, and the openings may be located within the bottom wall of the stiffeners. Furthermore, the stiffeners may have an inner ridge extending substantially parallel to side walls. The inner ridge may extend from the bottom wall of said stiffeners.

The posts may be embedded into concrete and may include two or more top step support posts with a top step stiffener bonded to the bottom surface of a top step of the prefabricated stairs. The top step support posts may be insertable within the openings of the top step stiffener. The top step support posts rest upon a stable surface. Two or more bottom step support posts may support with a bottom step stiffener bonded to the bottom surface of a bottom step of the prefabricated stairs. The bottom step support posts may be insertable within openings within the bottom step stiffener. Two or more intermediate step support posts may support an intermediate step stiffener bonded to the intermediate surface of a bottom step of the prefabricated stairs. The intermediate step support posts may be insertable within the opening of the intermediate step stiffeners.

The system may further include one or more locking mechanisms adapted to lock the posts into the openings within the stiffeners. The locking mechanism may comprise a spring clip placed within the posts. The locking mechanisms may be a spring mechanism engaged to allow one or more protrusions to extend radially from the posts. The radially extending protrusions may be depressible radially inward to allow the posts to be insertable with the openings. The protrusions maintain the posts within the openings when the posts are inserted into the openings, the protrusions extending radially outward to contact the inner surface of said bottom wall of said stiffeners.

The invention also encompasses a method of installing a modular stair support system by setting a prefabricated set of stairs on a stable surface, and mounting a plurality of posts into a corresponding plurality of openings within stiffeners. The stiffeners extend lengthwise substantially along the entire length of the bottom surfaces of steps of the stairs and the openings are sized to receive the posts therein.

Posts are set on said stable surface to support the top step of said prefabricated set of stairs. Bottom step posts are mounted within a stiffener bonded to the bottom surface of the bottom step. Intermediate step posts are also mounted within a stiffener bonded to the intermediate surface of the intermediate step. The bottom step support posts and intermediate step support posts have a space between the bottoms and the stable surface. A foot may be placed onto the bottoms of the step support posts prior to setting these posts on the stable surface. The concrete is poured onto the stable surface and the posts embedded in the bottoms of said intermediate posts within said bottom posts and said stable surface. The stiffeners may be bonded to the bottoms of the steps. The posts may be attached into the corresponding openings by locking the posts into the openings. The locking may be done by depressing at least one spring loaded protrusion extending radially from the posts.

A foot may be placed onto the bottoms of the step support posts prior to setting these posts on the stable surface.

BRIEF DESCRIPTION OF THE DRAWINGS

The invention may best be understood by reference to the detailed description of a preferred embodiment when referred to in conjunction with the drawings depict herein in which.

DETAILED DESCRIPTION OF A PREFERRED EMBODIMENT

The stair support system in accordance with the principles of the present invention utilizes a plurality of structural members in a modular assembly constructed to support loads applied to a pre-fabricated set of stairs useable for a pool or spa which is typically made of plastic. A pre-fabricated pool or spa stairs may be supported by utilizing a plurality of stiffeners each extending along the length of the bottom of a step of the prefabricated stairs. Within the stiffeners are a plurality of openings within which posts may be inserted. The posts contact the bottom surface of the top side of each stiffener to support the stiffener and a load placed upon the step supported by the stiffener. The stiffener is constructed to help minimize deflection of the step when a load off is placed thereon. A locking mechanism may be used to lock each post within into the opening. If desired, only posts supporting the top step may be placed upon a stable surface and the remaining posts, after insertion into their respective openings, may remain hanging above the stable surface. Concrete may be poured on the stable surface to embed each of the posts therein.

Figure 1:
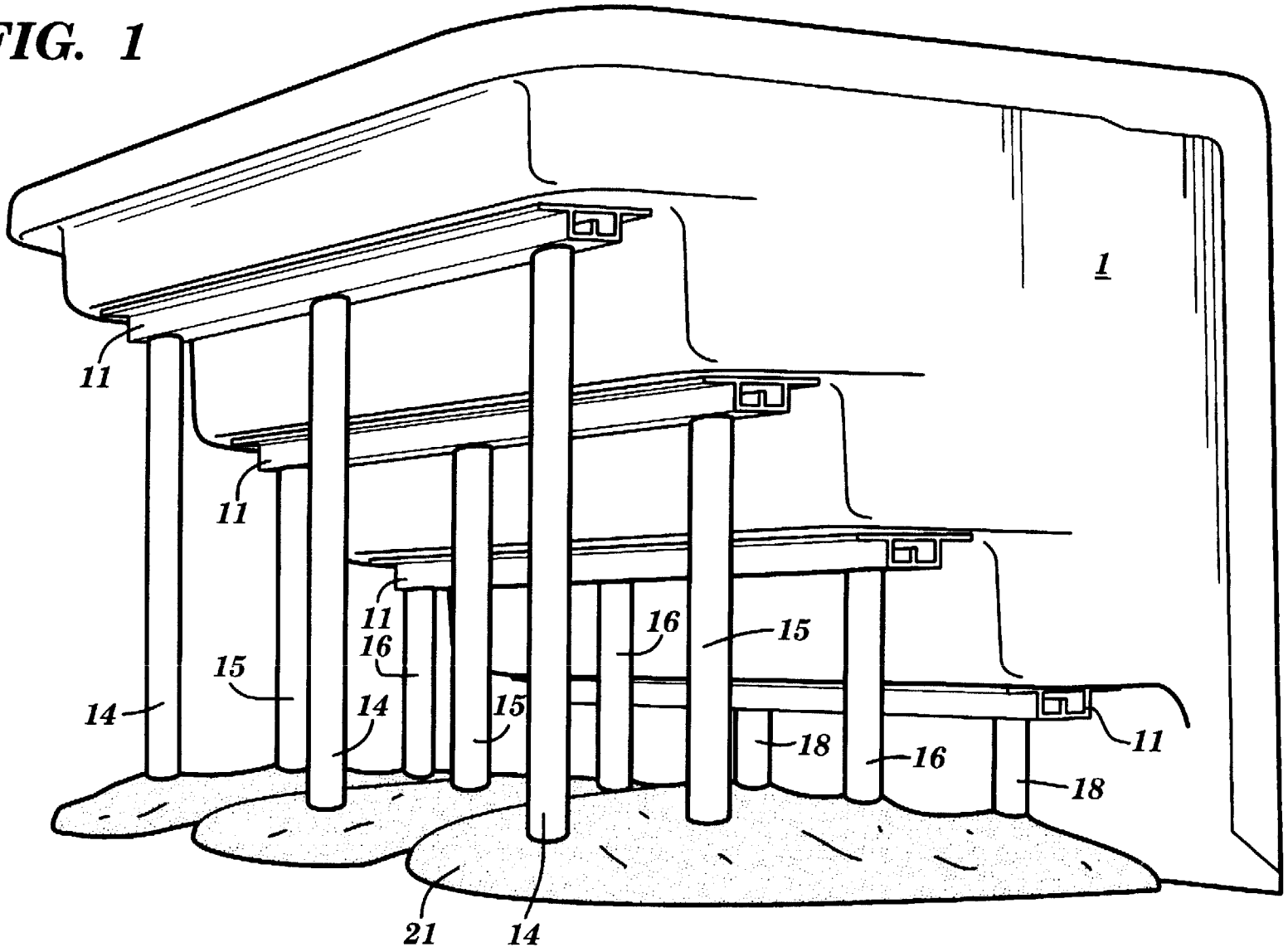
FIG. 1 depicts an isometric view of the modular pool stair support system assembled in accordance with the principles of the present invention.
Figure 2:
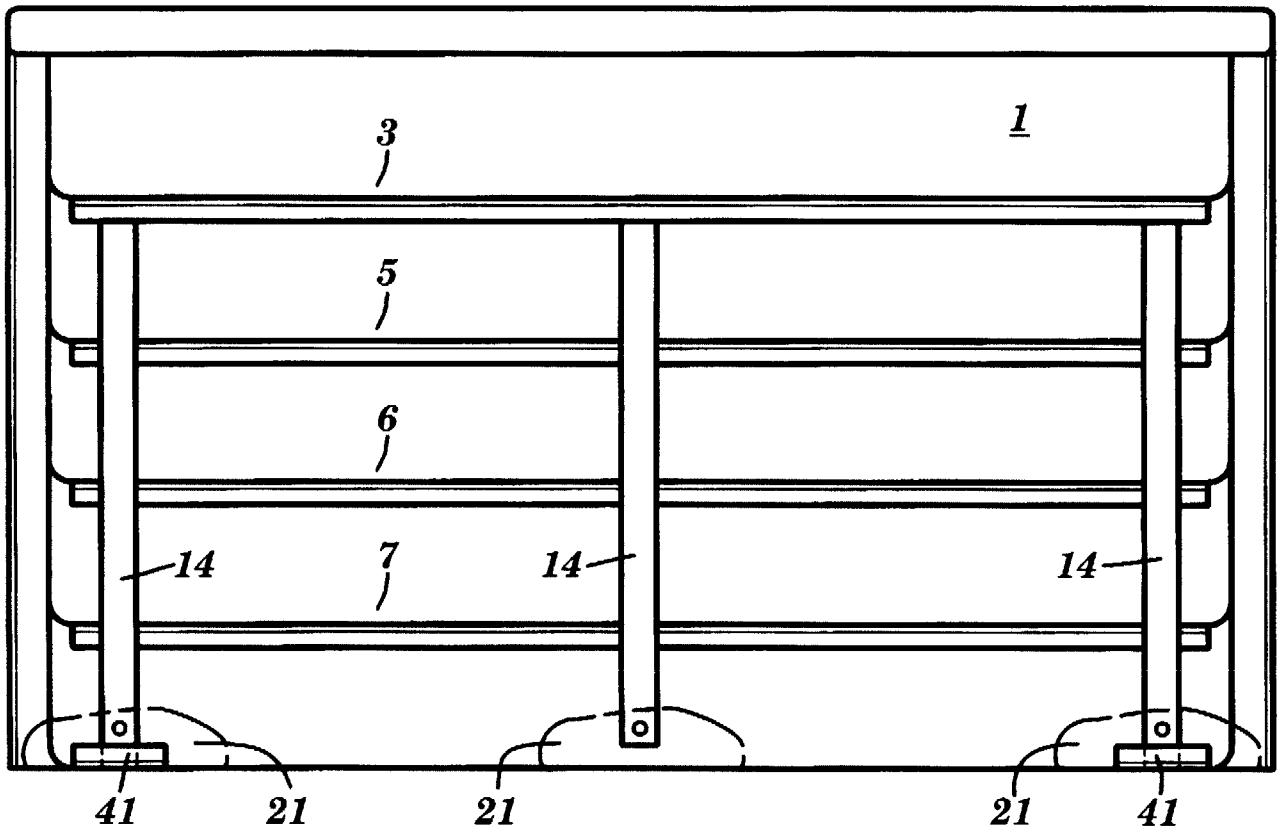
FIG. 2 depicts a rear elevational view of the modular pool stair support system of FIG. 1 assembled in accordance with the principles of the present invention.
Figure 3:
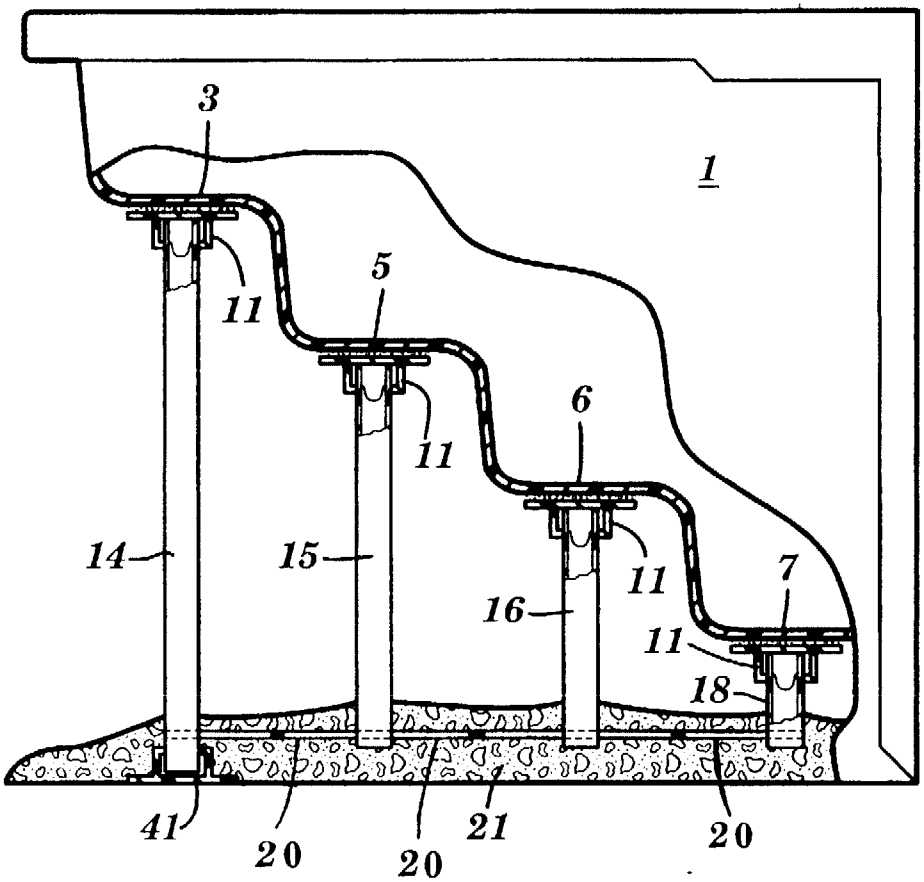
FIG. 3 depicts a side view of the modular pool stair support system of FIG. 1 assembled in accordance with the principles of the present invention.
Figure 4:
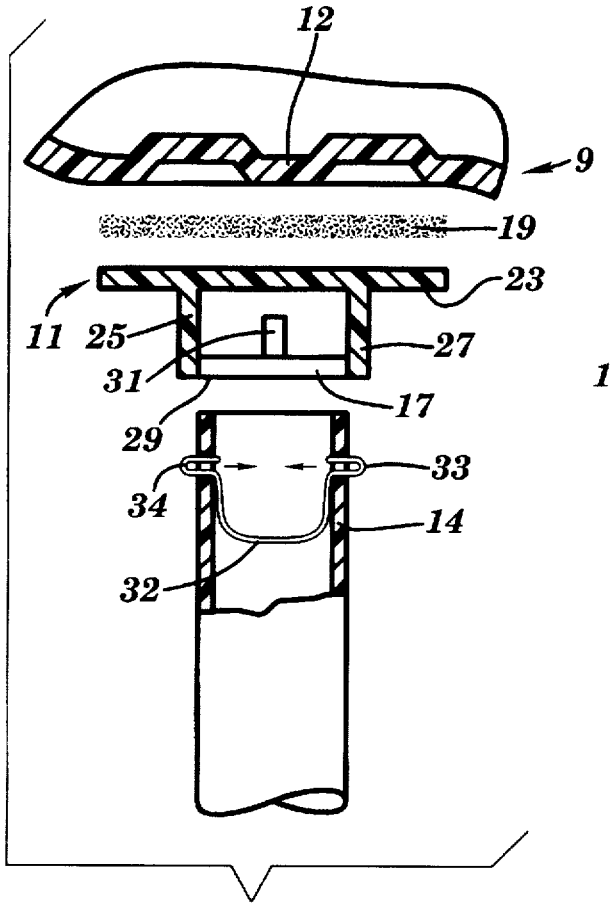
FIG. 4 depicts an exploded sectional view of the underside of a step, stiffener, bonding material and post of the pool stair in accordance with the principles of the present invention.
Figure 5:
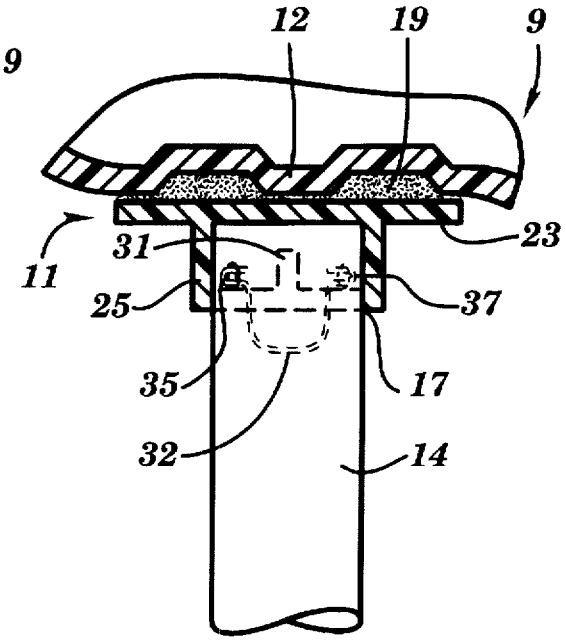
FIG. 5 depicts an exploded sectional view of the assembled parts depicted in FIG. 4, in accordance with the principles of the present invention.
Figure 6:
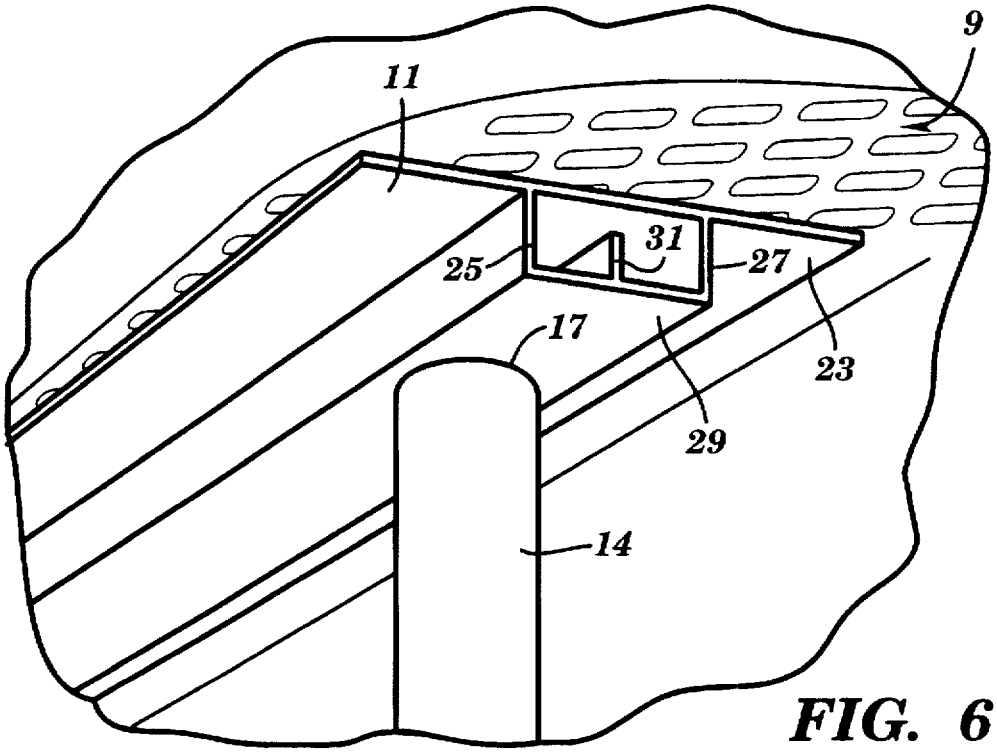
FIG. 6 depicts an exploded isometric view of the underside of a step of a prefabricated stair system having a stiffener and post supporting the same in accordance 21 the principles of the present invention.

Referring to FIGS. 1–3, a typical four step pre-fabricated set pool stairs 1 is shown. As is well known in the art, the pre-fabricated pool stairs are typically molded of ABS plastic. As shown in FIG. 3, the pool stairs 1 include a top step 3, first intermediate step 5, second intermediate step 6 and a bottom step 7. Typically, each step has a textured surface on the top thereof to prevent a person's foot from slipping while ascending or descending the stairs. As is shown in FIGS. 4, 5, and 6, the bottom surface 9 of each step of the stairs 1 is not smooth, but rather is formed of a plurality of intersecting ridges 11 located on the bottom surface of the stairs forming a waffle or grid-like pattern. This grid-like pattern typically extends substantially along the length of the underside of a step of the pool stairs.

As shown in FIGS. 1, 2 and 3, located on the underside of each step of the stairs 1 are a plurality of stiffeners 11 which in one embodiment may be of the shape and cross-section as shown in FIGS. 4, 5 and 6. Each stiffener helps prevent deflection of the step it supports when a load is applied thereon. The stiffeners 11 each may have one or more openings 17 therein sized to tightly receive a post therein. Post 14, 15, 16 18 are placed within openings on the bottoms of the stiffeners to support the steps. The stiffeners may be integrally formed on the bottom of the steps of the stairs 1 during fabrication thereof. Alternatively, the stiffeners 11 may be bonded, either prior to the bottom surface of each step of the stairs 1 using a bonding material 19 such as a urethane glue or bond. Preferably, the stiffeners should be constructed of the same material as the stairs, e.g., ABS plastic, and may be also bonded thereto using a conventional urethane glue. Use of the same material is preferred so that the coefficient of expansion of the stair steps and stiffeners is the same. This will result in similar expansion and contraction of the step and stiffener to avoid delamination and separation therebetween. The stiffeners, therefore, may be easily fabricated using an extrusion process where the stiffeners are each formed as a single unitary member. Using this technique, the openings can be drilled into the stiffeners after they have been extruded.

A plurality of posts 14, 15, 16, 18 each similar to the post 14, shown in FIGS. 4, 5 and 6, are inserted into the openings in each of the stiffeners 11, 13, 15, 16 and set into concrete 21 which is preferably four inches or more thick. Preferably, the posts comprise lengths of ABS or PVC plastic pipe and the top sections thereof are placed within one of the openings in the stiffeners.

As is shown in FIG. 1, the modular stair support system includes a plurality of stiffeners located on the underside of the step of a pre-fabricated set of stairs along with a plurality of posts 14, 15, 16, 18 inserted into openings within the stiffeners to support the weight of the pre-fabricated stairs. Referring now to FIGS. 4, 5 and 6, the relationship and configuration of the bottom of any step, stiffener, and post are shown. Each of the steps, stiffeners, and posts depicted in FIG. 1, may be configured and assembled as depicted in FIGS. 4, 5 and 6. For convenience, however, in FIGS. 4, 5 and 6, only one stiffener 11, post 14, step 9 and opening 17 are shown. Referring to FIG. 6, one specific configuration of a stiffener 11 is shown. The stiffener contains a top side 23 having a width which is substantially equal to the width of the bottom surface 9 of the step of the prefabricated stairs. In addition, the length of the stiffener is substantially equal to the length of the underside of a step, as can be seen in FIG. 2. Referring still to FIG. 6, a pair of side walls 25, 27, extend downward from the top side of the stiffener, substantially perpendicular thereto and also along the entire length of the member. The distance between side walls 25, 27 may be less than the width of the top side 23 of the stiffener. The side walls 25, 27 of the stiffener terminate at the bottom side or wall 29 of the stiffener within which a plurality of opening 17 are located. An inner ridge 31 may be located in the area between the side walls 25, 27 and, may extend substantially perpendicularly from the bottom wall 29 of the stiffener. The center ridge 31 may extend throughout the length of the stiffener 11 but sections thereof which extend within or over the opening 17 should be removed to allow the post 14 to be inserted into the opening 17 and into the stiffener 11 into the area defined within side walls 25, 27, top wall 23 and bottom wall 29.

As can be seen in FIG. 4, the outside diameter of the post 14 should be sized to fit tightly within the openings 17 of the stiffener 11. The inner ridge 31 and opening 17 are oriented to prevent the post from shifting so that the post is maintained in axial alignment. Preferably, the fit between the post 14, inner ridge and opening 17 should be sufficiently tight to prevent any play therebetween and misalignment of the post 14. The post 14 should maintain axial alignment and, therefore, not shift radially within the opening. Specifically, the inner ridge, on each side of the opening 17, should contact the outer wall of the post 14 when inserted into the opening. This will prevent the post from shifting within the opening.

Referring now to FIG. 5, the post 14, when inserted into the opening 17 should contact the underside of the top wall 23 of the stiffener 11 so that the post will support the weight of a portion of the step of the prefabricated set of stairs. As shown in FIGS. 4 and 5, a locking mechanism may be used to lock the post 14 into an opening 17 of the stiffener 11. One type of locking mechanism is shown in FIGS. 4 and 5 and includes a spring-type locking ring 32 having a pair of protrusions 33, 34 which are placed into a diametrically spaced pair of holes, 35, 37 located at the top section of the post 14. This spring-type locking mechanism is configured to bias the protrusions 33 radially outward from the post 14 so that the protrusions extend radially outward a distance greater than the outside diameter of the post 14. However, the protrusions 33, 34 by applying a force radially inward thereto, may be depressed radially inward into the holes 35, 37 of the post 14. By depressing these depressible protrusions 33, 34 inward and inserting the top of the post 14 into the opening 17, the post may be placed within the opening of a stiffener 11 to support the weight thereof. After the post is inserted into the opening 17, the post can be rotated to a position as shown in FIG. 5 whereby the protrusions 33 do not contact the side walls 25, 27 of the stiffener and thereby will extend radially outward from the outside diameter of the post 14. In this position, the post 14 will be locked into the stiffener by the protrusions 33, 34 contacting the bottom wall 29 of the stiffener. If the distance between the inside surfaces of side walls 25 and 27 are the same as the diameter of opening 17, the post can be removed by rotating the post 14 into a position whereby the holes are juxtaposed to the side walls 25, 27 and the protrusion 33 of the spring-type locking mechanism are depressed radially inward by the side walls so that the post 14 may be pulled downward out of the opening 17. Preferably, the spring-type locking mechanism is made of a plastic type material possessing the appropriate physical characteristics to act as a locking mechanism. However, various other locking mechanisms, including spring-type locking mechanisms, including those made of another material may be used.

Figure 7:
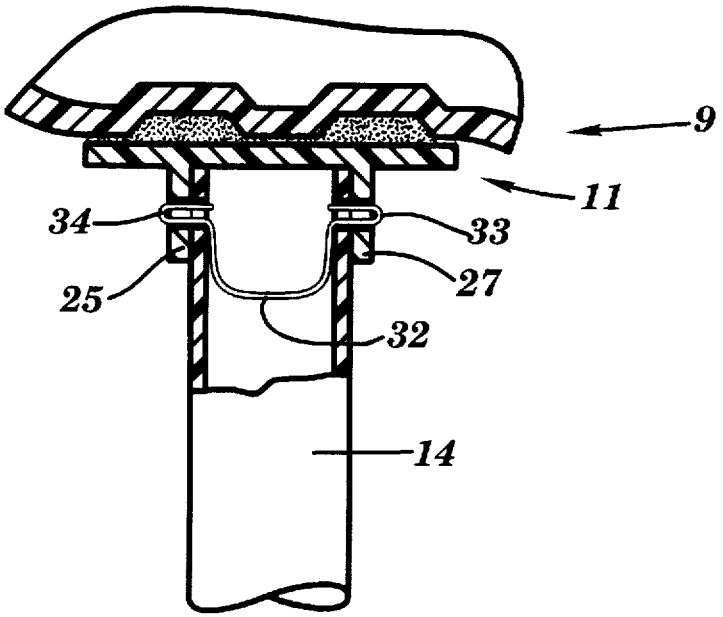
FIG. 7 depicts an alternative technique of securing a post to a stiffener bonded to the underside of a prefabricated stair step to that depicted in FIGS. 4 and 5.

Referring to FIG. 7, an alternative embodiment of a stiffener may be used. The stiffener is identical in configuration to the stiffeners 11 depicted in FIGS. 4, 5, and 6. However, in this embodiment, the stiffener 11 also contains a pair of diametrically opposed holes which are coaxially oriented within the side walls 25, 27 of the stiffener 11. In this embodiment, the locking mechanism is also of the spring-type, and protrusions 33, 34 located within holes 35, 37 of the post 14 will align with the holes within the side walls of the stiffener while the top of the post contacts the top side 23 of the stiffener. The post will be locked into place when the protrusions are aligned so that they extend into the holes within the side walls of the stiffeners. The post may be removed by depressing the protrusions radially inward to a location whereby the post 14 may be pulled downwardly out of the opening 17.

Installation of the modular pool stair support system of the present invention will now be described. Initially, a prefabricated set of stairs 1 is placed within on a stable surface. Stiffeners may be then bonded to the bottom of each step, 3, 5, 6, 7, respectively. Alternatively, the stiffeners may be bonded to the bottom of steps prior to setting the pre-fabricated set of stairs on the stable surface, or the stiffeners may be integrally formed onto the pre-fabricated set of stairs at the time the stairs are fabricated. If bonding of the stiffeners occurs in the field, a layer of glue or bonding material, such as a urethane glue or bond, 19 is placed between the surface of the steps 9 and the top wall 23 of the stiffener, as is shown in FIGS. 4 and 5. The top step posts may be placed within a foot 41 which rests upon the stable surface and inserted into the openings of the stiffener 11 bonded to the bottom of the top step 3. The foot may contain an opening therein which allows the post 14 to be inserted therein, preferably tightly.

The length of the bottom step posts 18 may be precut, or may be custom cut in the field at the time of installation. After the top step support posts are installed, intermediate step posts 15, 16 used to support the intermediate steps 5, 6 and the stiffeners 11 bonded to the bottoms thereof may then be installed. These posts are either precut or cut to a size in the field which will allow the posts to be inserted into the openings of the stiffeners and extend downwardly to a distance above the stable surface upon which the stairs are set. Preferably, an inch and a half to two inches of space should remain between the bottom of the intermediate post and the stable surface. Once all the intermediate posts 15, 16 are installed, concrete 21, may be poured onto the stable surface to cover the bottom portions of each of the posts so that all of the posts are embedded into the concrete. Preferably, the thickness of the concrete should be four inches or more. As is shown in FIG. 3, multiple pieces of rebar 20 may be used to strengthen the concrete. The rebar 20 may be inserted through holes within the bottoms of the posts to ensure that the posts do not shift within the concrete even if the concrete cracks. Use of the rebar 20 will help prevent movement of the stairs even if the stable surface upon which the posts are mounted should shift or sink. For ease of installation each post may have a different piece of rebar inserted into its bottom.

As shown in FIG. 2, located along at different points along the length of the stairs 1 are rows of posts, each post may be made of 2 inch ABS plastic. Each row of posts may be spaced approximately 3 feet close to the nearest row of posts along the length of the pool stairs 1. However, in other words, each post supporting the same step may be spaced approximately 3 feet apart. Moreover, although a four-step stair and a support system therefor is depicted herein, the present invention may be used in the construction of a pool having pre-fabricated plastic stairs of three more or less steps. In such a support system, fewer or additional stiffeners and posts may be used.

Although the invention has been described in connection with the embodiments disclosed herein, it will be apparent to one of ordinary skill in the art that various modifications may be made to the components described herein without departing in any way from the scope of the invention. For example, various different shapes of structural members, stiffening elements, and connectors, may be used. These and other modifications or substitutions are intended to be within the scope of the invention as defined by the following claims.

What is claimed is:

1. A modular stair support system supporting steps of a prefabricated set of stairs, said steps having a length and a bottom surface, comprising:

a plurality of posts for supporting said steps; and a plurality of stiffeners extending lengthwise substantially along the entire length of the bottom surface of the steps, said stiffeners having a plurality of openings therein, said openings being sized to receive said posts therein while maintaining axial alignment of said posts in a direction normal to said steps.

2. The system of claim 1 wherein said stiffeners comprise a top side bonded to the bottom of said steps.

3. The system of claim 2 wherein said top side of said stiffeners is of a width greater than the diameter of said posts.

4. The system of claim 3 wherein said stiffeners further comprise a pair of side walls extending from said top side, said side walls being separated by a distance greater than or equal to the outside diameter of said posts.

5. The system of claim 4 wherein said stiffeners comprise a bottom wall extending between said side walls wherein said openings are located within said bottom wall of said stiffeners.

6. The system of claim 5 wherein said stiffeners comprise an inner ridge, said inner ridge and said openings being oriented to maintain axial alignment of said posts within said openings.

7. The system of claim 6 wherein said stiffeners are formed by an extrusion process.

8. The system of claims 1, 5 or 7 wherein said posts comprise two or more top step support posts and said stiffeners comprise a top step stiffener bonded to the bottom surface of a top step of said pre-fabricated stairs, said top step support posts being insertable within said openings of said top step stiffener.

9. The system of claim 8 wherein said top step support posts rest upon a stable surface.

10. The system of claim 8 wherein said posts comprise two or more bottom step support posts and said stiffeners comprise a bottom step stiffener bonded to the bottom surface of a bottom step of said pre-fabricated stairs, said bottom step support posts being insertable within said opening of said bottom step stiffeners.

11. The system of claim 10 wherein said posts comprise two or more intermediate step support posts and said stiffeners comprise a intermediate step stiffener bonded to the bottom surface of an intermediate step of said pre-fabricated stairs, said intermediate step support posts being insertable within said openings of said intermediate step stiffeners.

12. The system of claim 11 further comprising one or more locking mechanisms adapted to lock said posts within said openings of said stiffeners.

13. The system of claim 12 wherein said locking mechanisms comprise a spring mechanism engaged to allow one or more protrusions to extend radially from said posts, said radially extending protrusions being depressible radially inward to allow said posts to be insertable with said openings.

14. The system of claim 13 wherein said one or more protrusions maintains the posts within said openings when the posts are inserted into the openings such that the protrusions extending radially outward to contact the inner surface of said bottom wall of said stiffeners.

15. The system of claim 13 wherein said locking mechanism comprises a spring clip.

16. The system of claim 4 wherein said post comprises a spring mechanism engaged to allow one or more protrusions to extend radially from said posts, said radially extending protrusions being depressible radially inward to allow said posts to be insertable within said openings.

17. The system of claim 16 wherein said one or more protrusions maintains the posts within said openings when the posts are inserted into the openings such that the protrusions extending radially outward to contact the inner surface of said bottom wall of said stiffeners.

18. The system of claim 12 wherein said posts are embedded into concrete.

19. The system of claim 18 wherein rebar is set into said concrete.

20. The system of claim 19 wherein said rebar is inserted through holes formed within bottoms of said posts.

21. A method of installing a modular stair support system comprising:

setting a prefabricated set of stairs on a stable surface, said prefabricated set of stairs having steps with a length and a bottom surface;

mounting a plurality of posts into a corresponding plurality of openings within stiffeners, said stiffeners extending lengthwise substantially along the entire length of the bottom surface of said steps, said openings being sized to receive the posts therein.

22. The method of claim 21 further comprising setting at least two of said posts on said stable surface wherein said at least two of said posts support a top step of said prefabricated set of stairs.

23. The method of claim 21 wherein said posts comprise at least two bottom step support posts and wherein said bottom step posts are mounted within a stiffener bonded to the bottom surface of a bottom step.

24. The method of claim 23 wherein said posts comprise at least two intermediate step support posts and wherein said intermediate step posts are mounted within a stiffener bonded to the bottom surface of an intermediate step.

25. The method of claim 24 wherein said bottom step support posts and intermediate step support post have a space between the bottom thereof and the stable surface.

26. The method of claim 25 further comprising pouring concrete on said stable surface and embedded in the bottom of said intermediate post and said bottom post and said stable surface.

27. The method of claim 24 further comprising pouring said concrete around said at least two posts set on said stable surface.

28. The method of claim 23 further comprising bonding said stiffeners to the bottoms of said steps.

29. The method of claim 28 wherein mounting said plurality of posts into said corresponding openings comprises locking said posts into said openings.

30. The method of claim 29 wherein said locking comprises depressing at least one spring loaded protrusion extending radially from said posts.

31. The method of claim 30 further comprising placing a foot onto the bottoms of said at least two posts prior to setting said at least two posts on said stable surface.

32. The apparatus of claim 30 wherein said stiffeners are integrally formed to the bottom of said steps.

33. The method of claim 29 wherein said stiffeners comprise a top side bonded to the bottom of said steps.

34. The method of claim 33 wherein said top side of said stiffeners is of a width greater than the diameter of said posts.

35. The method of claim 34 wherein said stiffeners further comprise a pair of side walls extending from said top side, said side walls being separated by a distance greater than or equal to the outside diameter of said posts.

36. The method of claim 35 wherein said stiffeners comprise a bottom wall extending between said side walls wherein said openings are located within said bottom wall of said stiffeners.

37. The method of claim 35 wherein said stiffeners comprise an inner ridge which maintains said posts axially aligned within said openings.

38. The method of claim 37 wherein said stiffeners are formed by an extrusion process.

39. The method of claim 27 further comprising setting rebar into said concrete.

40. The method of claim 39 wherein said rebar is inserted through holes with said posts.

* * * * *